United States Patent [19]

Oetting

[11] Patent Number: 4,834,028

[45] Date of Patent: May 30, 1989

[54] PISTON COOLING SYSTEM FOR A RECIPROCATING PISTON INTERNAL COMBUSTION ENGINE

[75] Inventor: Hermann Oetting, Braunschweig, Fed. Rep. of Germany

[73] Assignee: Volkswagen AG, Wolfsburg, Fed. Rep. of Germany

[21] Appl. No.: 162,669

[22] Filed: Mar. 1, 1988

[30] Foreign Application Priority Data

Mar. 7, 1987 [DE] Fed. Rep. of Germany ..... 3707376

[51] Int. Cl.[4] ..... F01P 3/08; F02F 3/22; F01M 5/02; F02M 25/02

[52] U.S. Cl. ..... 123/41.35; 123/573

[58] Field of Search ..... 123/41.17, 41.23, 41.35, 123/573

[56] References Cited

U.S. PATENT DOCUMENTS

| | | | |
|---|---|---|---|
| 343,745 | 6/1886 | Wilcox | 123/41.35 |
| 1,073,197 | 9/1913 | Westinghouse | 123/41.35 |
| 1,076,736 | 10/1913 | Baker | 123/41.35 |
| 1,140,987 | 5/1915 | Kube | 123/41.35 |
| 1,928,033 | 9/1933 | Schaer | 123/41.35 |
| 3,175,546 | 3/1965 | Roper | 123/573 X |
| 4,269,607 | 5/1981 | Walker | 123/573 X |

FOREIGN PATENT DOCUMENTS

| | | |
|---|---|---|
| 1905609 | 8/1970 | Fed. Rep. of Germany . |
| 2007801 | 9/1971 | Fed. Rep. of Germany . |
| 2033960 | 1/1972 | Fed. Rep. of Germany . |
| 2539470 | 3/1977 | Fed. Rep. of Germany . |
| 2612378 | 10/1977 | Fed. Rep. of Germany . |
| 3410261 | 10/1986 | Fed. Rep. of Germany . |

*Primary Examiner*—Tony M. Argenbright
*Assistant Examiner*—Eric R. Carlberg
*Attorney, Agent, or Firm*—Brumbaugh, Graves, Donohue & Raymond

[57] ABSTRACT

In the representative piston cooling system for an internal combustion engine described in the specification, an evaporation coolant is sprayed on the rear side of a piston by at least one nozzle and the coolant vapor is removed from the crankcase through a blow-by line passing to a condenser which supplies condensed coolant to a coolant reservoir from which the blow-by gases are conveyed to the intake manifold of the internal combustion engine by way of a connecting line.

5 Claims, 1 Drawing Sheet

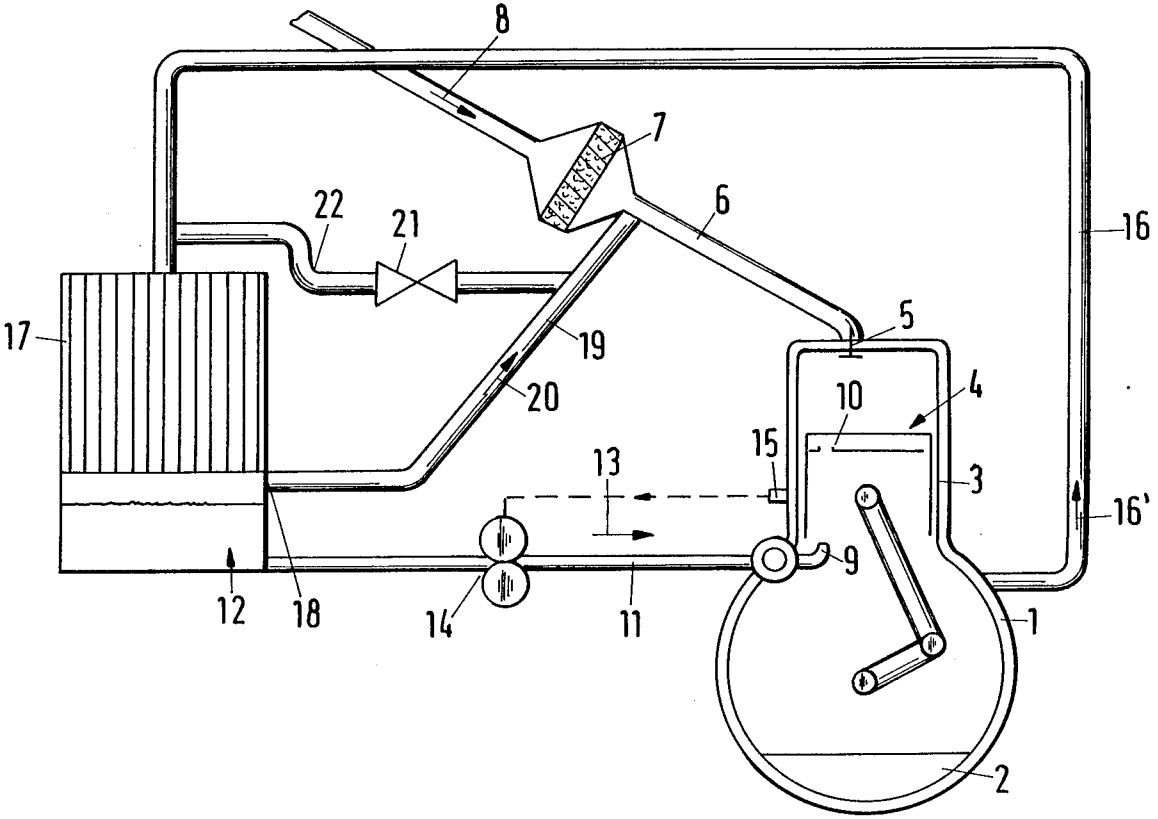
16
16'
1
2
3
4
5
10
9
15
6
7
13
11
19
20
8
14
21
22
18
12
17

PISTON COOLING SYSTEM FOR A RECIPROCATING PISTON INTERNAL COMBUSTION ENGINE

BACKGROUND OF THE INVENTION

This invention relates to piston cooling systems for internal combustion engines wherein coolant is applied to the rear side of the piston. Such piston cooling systems are known from a number of publications, e.g., DE-OS Nos. 19 05 609 and 20 07 801, as well as DEP No. 2,539,470. In the piston cooling systems described in those publications, the coolant used is the oil which also serves to lubricate the internal combustion engine. According to those publications, the oil is sprayed by nozzles onto the rear of the piston and, to increase the heat transfer, the piston may be provided with ribs or oil-collecting grooves. Thus, the cooling effect of these known piston cooling systems is solely the result of the temperature difference between the piston and the oil.

Increased cooling efficiency for internal combustion engines may be obtained by evaporation cooling arrangements such as described, for example, in DE-OS No. 20 33 960 and DEP No. 3,410,261. Whereas the aforementioned Offenlegungsschrift stresses in particular the construction of a condenser for such a vapor cooling system, DEP No. 3,410,261 describes an evaporation cooling system whereby a coolant is injected into cooling spaces in the cylinder jacket and, respectively, the cylinder head of the internal combustion engine in an amount which is a function of an engine temperature or the load condition of the internal combustion engine by a correspondingly controlled pump. The coolant employed is water with the possible addition of an alcohol suitable for cooling purposes.

Such evaporation cooling devices offer the advantage that their cooling effect results not only from the temperature difference between the coolant and the engine, but also from the additional quantity of heat required for evaporation.

The injection of water into the cylinder space for cooling purposes is also known from DE-OS No. 26 12 378. However, because of the influence of this procedure on the combustion process, it can be utilized only in certain cases. Furthermore, the water injected is used up during operation of the engine.

SUMMARY OF THE INVENTION

Accordingly, it is an object of the present invention to provide a piston cooling system wherein coolant is applied to the rear of the piston which operates according to the principle of evaporation cooling in a simple and effective manner.

This and other objects of the invention are attained by providing a piston cooling system for an internal combustion engine having an arrangement for directing coolant at the rear of the piston and a blow-by line for removing coolant vapor from the engine crankcase along with a coolant condenser to which the vapor is supplied and a coolant reservoir for receiving condensed coolant and including a gas blow-by outlet from the reservoir. Thus, the system of the invention, in addition to providing evaporation cooling for direct piston cooling, also takes into account the fact that, in this special application of evaporation cooling, two different media, namely coolant and coolant vapors, on the one hand, and lubricating oil, on the other hand, are present simultaneously in the crankcase of the internal combustion engine, which media must not be mixed. The separation of these two media is effected in an elegant manner, primarily by means of a correspondingly extending blow-by line which, starting from the crankcase, leads to the condenser designed as a rule as part of the radiator for the internal combustion engine.

A further fundamental advantage of the invention is that it may be possible to dispense with a cylinder cooling jacket since approximately 40% to 50% of the heat to be removed from the engine can be removed through the piston cooling system arranged according to the invention. Also, the surface of the radiator for the internal combustion engine may be divided into approximately two equal half parts, of which one part is associated with the coolant coming from the cylinder head, whereas the other part serves as condenser for the coolant evaporated during piston cooling according to the invention.

If desired, the coolant employed for piston cooling can also serve to cool the lubricating oil flowing back or dripping into the oil pan of the engine after other parts of the internal combustion engine have been cooled. Moreover, additional measures may be taken for separating the coolant, which may be water, on the one hand, and lubricating oil, on the other hand. It is particularly easy to take such measures in the case of dry sump lubrication, in which a gas-coolant-oil mixture from the oil pan is conducted through a known separating tank. From the separating tank, the oil is removed by hydraulic oil pumps and is delivered to the lubrication points in the usual way, while the coolant is delivered to a supply pump and the blow-by gas is directed to the condenser.

It is also possible according to the invention to initiate operation of the piston cooling system only after warm-up of the internal combustion engine has been completed so that the fastest possible warm-up of the engine and the lubricating oil is ensured. For example, evaporation cooling according to the invention can be delayed until a selected temperature, such as 100° C., has been reached in the oil pan. In the event that piston cooling is required during the warm-up phase, the conventional piston cooling system directing lubricating oil at the piston can be used initially and then replaced by evaporation cooling according to the invention when a selected oil temperature is attained.

A further advantage of the invention results from the fact that conventional structures can be used for essential components of the cooling system, such as the condenser-coolant reservoir unit (cf. DE-OS No. 20 33 960 mentioned above). Furthermore, conventional measures for increasing the surface area of the rear side of the piston and for retaining the coolant on it may also be applied.

BRIEF DESCRIPTION OF THE DRAWING

Further objects and advantages of the invention will be apparent from a reading of the following description in conjunction with the accompanying drawing which is a schematic vertical sectional view illustrating a representative embodiment of a piston cooling system for internal combustion engines in accordance with the invention.

DESCRIPTION OF PREFERRED EMBODIMENT

In the typical internal combustion engine according to the invention shown schematically in the drawing, a crankcase 1 has an oil pan 2 and a cylinder 3 above the crankcase contains a reciprocable piston 4 to be cooled. A conventional intake valve 5, periodically actuated by a cam, not shown, delivers air or an air-fuel mixture into the cylinder 3 from an intake manifold 6 which receives it after it has passed through an air filter 7 as indicated by the arrow 8.

In the crankcase 1, a nozzle 9 is oriented so that it sprays an evaporation coolant, such as water, onto the rear side of the piston 4. Moreover, the rear side of the piston is provided with an arrangement 10 for increasing the surface and lengthening the retention time of the coolant. The coolant, which provides evaporation cooling of the piston 4, is supplied in the direction of the arrow 13 through the feed line 11 from a coolant reservoir 12 by a pump 14. The rate of coolant delivery provided by the pump 14 is controlled by signals from a temperature sensor 15 so that a selected upper temperature value in the cylinder wall 3 is not exceeded. In place of a temperature sensor, a load or output sensor for the operating load of the internal combustion engine can also be employed.

The coolant can be delivered at a rate high enough to assure that part of the coolant remains in a liquid state and falls from the piston onto the hot lubricating oil in the oil pan 2 and thus cools the lubricating oil by evaporation.

The coolant vapor produced by evaporation in the crankcase 1 is withdrawn through a blow-by line 16 in the direction of the arrow 16' to a condenser 17. The coolant condensed therein falls into the coolant reservoir 12, which has a blow-by outlet 18, and the blow-by gas is withdrawn by way of a line 19 connecting the blow-by outlet 18 with the intake manifold 6. The blow-by gas passes through the line 19 in the direction of the arrow 20 to the intake manifold 6 from which it is delivered to the combustion chamber.

If the coolant level in the reservoir 12 rises above the level of the blow-by outlet 18, the blow-by gas is thereby blocked from passing into the condenser 17 and the coolant reservoir 12. In that case, a valve 21 in a bypass line 22 between the blow-by line 16 and the intake manifold 6 is opened by signals from a coolant level sensor (not shown), which may be mounted in the reservoir 12, in the condenser 17 or in the connecting line 19. When this occurs, the blow-by gases will bypass the condenser 17 and reach the intake manifold 6 directly from the blow-by line 16.

The embodiment of the invention described herein demonstrates that an effective piston cooling system is provided by the invention which can dispense with conventional coolant chambers or conduits in the piston and in the cylinder wall.

Although the invention has been described herein with reference to a specific embodiment, many modifications and variations therein will readily occur to those skilled in the art. Accordingly, all such variations and modifications are included within the intended scope of the invention.

I claim:

1. A piston cooling system for a reciprocating piston internal combustion engine comprising an engine having a cylinder and a piston mounted for reciprocation therein, nozzle means for directing evaporation coolant towards the rear side of the piston, reservoir means for holding a supply of coolant, feed line means for supplying coolant from the reservoir means to the nozzle means, pump means for pumping coolant through the feed line means, blow-by line means for removing coolant vapor from the engine, condenser means for receiving vaporized coolant from the blow-by line means and supplying condensed coolant to the reservoir means, and blow-by outlet means in the reservoir means for discharging blow-by gas therefrom, herein the engine includes an intake manifold and including connecting means connecting the blow-by outlet means with the intake manifold.

2. A piston cooling system according to claim 1, including bypass means between the intake manifold and an input of the condenser means and including valve means for opening the bypass means when the coolant level in the reservoir means is higher than the level of the blow-by outlet means.

3. A piston cooling system for a reciprocating piston internal combustion engine comprising an engine having a cylinder and a piston mounted for reciprocation therein, nozzle means for directing evaporation coolant towards the rear side of the piston, reservoir means for holding a supply of coolant, feed line means for supplying coolant from the reservoir means to the nozzle means, pump means for pumping coolant through the feed line means, blow-by line means for removing coolant vapor from the engine, condenser means for receiving vaporized coolant from the blow-by line means and supplying condensed coolant to the reservoir means, and blow-by outlet means in the reservoir means for discharging blow-by gas therefrom, including detecting means for detecting an operating parameter of the engine and controlling the operation of the pump means in accordance therewith.

4. A piston cooling system for a reciprocating piston internal combustion engine comprising an engine having a cylinder and a piston mounted for reciprocation therein, nozzle means for directing evaporation coolant towards the rear side of the piston, reservoir means for holding a supply of coolant, feed line means for supplying coolant from the reservoir means to the nozzle means, pump means for pumping coolant through the feed line means, blow-by line means for removing coolant vapor from the engine, condenser means for receiving vaporized coolant from the blow-by line means and supplying condensed coolant to the reservoir means, and blow-by outlet means in the reservoir means for discharging blow-by gas therefrom, including oil pan means beneath the piston to receive liquid coolant therefrom to cool oil held in the oil pan by evaporation, the pump means being controlled to supply liquid coolant at a rate high enough to provide liquid coolant for oil cooling as well as piston cooling.

5. A piston cooling system according to claim 4 including separating means for receiving a gas-coolant-oil mixture from the oil pan means and for supplying oil to lubricating points in the engine, coolant to the reservoir means, and blow-by gas to the condenser means.

* * * * *